US010782064B2

(12) United States Patent
Hong et al.

(10) Patent No.: US 10,782,064 B2
(45) Date of Patent: Sep. 22, 2020

(54) REFRIGERATOR

(71) Applicant: Samsung Electronics Co., Ltd., Suwon-si, Gyeonggi-do (KR)

(72) Inventors: Young Bae Hong, Gwangju (KR); Sung Cheul Park, Gwangju (KR); Youn Tae Shin, Gwangju (KR); Oun Gu Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/190,816

(22) Filed: Nov. 14, 2018

(65) Prior Publication Data

US 2019/0078834 A1 Mar. 14, 2019

Related U.S. Application Data

(63) Continuation of application No. 15/270,521, filed on Sep. 20, 2016, which is a continuation of application (Continued)

(30) Foreign Application Priority Data

Apr. 10, 2012 (KR) ..... 10-2012-0037499

(51) Int. Cl.
*F25D 23/04* (2006.01)
*F25D 23/02* (2006.01)

(Continued)

(52) U.S. Cl.
CPC ..... *F25D 23/04* (2013.01); *F25D 11/02* (2013.01); *F25D 23/02* (2013.01); *F25D 23/021* (2013.01);

(Continued)

(58) Field of Classification Search
CPC ..... F25D 23/02; F25D 23/04; F25D 23/021; F25D 23/025; F25D 25/05; F25D 25/022;

(Continued)

(56) References Cited

U.S. PATENT DOCUMENTS 1,761,303 A 6/1930 D E Hunter
2,801,146 A 7/1957 Mikulas (Continued)

FOREIGN PATENT DOCUMENTS

CN 1132614 A 10/1996
CN 1132614 A 10/1996

(Continued)

OTHER PUBLICATIONS

International Search Report dated Jul. 9, 2013 in corresponding International Application No. PCT/KR2013/002900.

(Continued)

*Primary Examiner* — Daniel J Troy
*Assistant Examiner* — Ryan A Doyle
(74) *Attorney, Agent, or Firm* — Staas & Halsey LLP

(57) ABSTRACT

In a refrigerator including a sliding door configured to open and close a storage chamber, a storage basket provided on a rear portion of the sliding door, and a support frame configured to support the sliding door and the storage basket, sidewalls of the storage basket may be formed so as to protrude outwardly except a lower portion in which the support frame is disposed between an inner case and the sidewalls, thereby increasing a storage space of the storage basket. In addition, a front protrusion, an auxiliary protrusion, and a rear protrusion are formed in an upper portion of the storage basket, and therefore a relative position of an auxiliary basket to the storage basket may be limited, and the auxiliary basket may be drawn into and out in conjunction with drawn-in and-out movements of the storage basket.

6 Claims, 6 Drawing Sheets

Related U.S. Application Data

No. 13/859,337, filed on Apr. 9, 2013, now Pat. No. 9,557,096.

(51) Int. Cl.

| | |
|---|---|
| ***F25D 25/00*** | (2006.01) |
| ***F25D 23/06*** | (2006.01) |
| ***F25D 25/02*** | (2006.01) |
| ***F25D 11/02*** | (2006.01) |
| ***A47B 88/75*** | (2017.01) |

(52) U.S. Cl.

CPC ..... *F25D 23/028* (2013.01); *F25D 23/067* (2013.01); *F25D 25/005* (2013.01); *F25D 25/025* (2013.01); *A47B 88/75* (2017.01); *A47B 2210/17* (2013.01); *A47B 2210/175* (2013.01); *F25D 25/022* (2013.01)

(58) Field of Classification Search

CPC ... F25D 25/025; A47B 88/75; A47B 2210/17; A47B 2210/175

See application file for complete search history.

(56) References Cited

U.S. PATENT DOCUMENTS

| | | | |
|---|---|---|---|
| 2,955,441 | A | 10/1960 | Dahlgren et al. |
| 3,038,774 | A | 6/1962 | Cyrus |
| 4,579,402 | A | 4/1986 | Wenzlick et al. |
| 4,936,641 | A | 6/1990 | Bussan et al. |
| 6,565,170 | B2 | 5/2003 | Banicevic et al. |
| 7,281,775 | B2 | 10/2007 | Yang |
| 7,740,331 | B2 | 6/2010 | Koo |
| 7,748,804 | B2 | 7/2010 | Lim et al. |
| 8,408,663 | B2 | 4/2013 | Chellappan et al. |
| 8,562,087 | B2 | 10/2013 | Eom |
| 2005/0093409 | A1 | 5/2005 | Vardon |
| 2005/0156494 | A1 | 7/2005 | Bergmann et al. |
| 2005/0160854 | A1 | 7/2005 | Rotter |
| 2006/0017360 | A1 | 1/2006 | Lyvers et al. |
| 2006/0033410 | A1 | 2/2006 | Koons |
| 2006/0152119 | A1 | 7/2006 | Park |
| 2007/0035221 | A1 | 2/2007 | Koo |
| 2007/0144408 | A1 | 6/2007 | Rotter |
| 2008/0074019 | A1 | 3/2008 | Park et al. |
| 2008/0203875 | A1 | 8/2008 | Lim et al. |
| 2008/0314067 | A1 | 12/2008 | Lee |
| 2009/0026906 | A1 | 1/2009 | Kim |
| 2009/0261698 | A1 | 10/2009 | Cabal Velarde et al. |
| 2010/0066224 | A1 | 3/2010 | Placke et al. |
| 2010/0090574 | A1 | 4/2010 | Lim et al. |
| 2011/0006656 | A1 | 1/2011 | Nam et al. |
| 2011/0048059 | A1 | 3/2011 | Song |
| 2011/0181163 | A1 | 7/2011 | Han et al. |
| 2011/0210655 | A1 | 9/2011 | Brown et al. |
| 2012/0062092 | A1 | 3/2012 | Jung et al. |
| 2012/0079845 | A1 | 4/2012 | Hong et al. |
| 2012/0139402 | A1 | 6/2012 | Haidar |
| 2012/0262044 | A1 | 10/2012 | Vulava |
| 2012/0306338 | A1 | 12/2012 | Nagahata |
| 2013/0093306 | A1 | 4/2013 | Shin |

FOREIGN PATENT DOCUMENTS

| | | | | |
|---|---|---|---|---|
| CN | 101169302 | A | 4/2008 | |
| CN | 101210762 | A | 7/2008 | |
| CN | 101231121 | A | 7/2008 | |
| CN | 101675310 | | 3/2010 | |
| CN | 201680664 | | 12/2010 | |
| CN | 101957120 | | 1/2011 | |
| CN | 102042739 | | 5/2011 | |
| CN | 102087069 | A | 6/2011 | |
| DE | 4445288 | A1 * | 6/1996 | ..... F25D 25/025 |
| EP | 0 718 571 | A1 | 6/1996 | |
| EP | 0718571 | A1 | 6/1996 | |
| EP | 2 405 219 | A1 | 1/2012 | |
| EP | 2 428 756 | A2 | 3/2012 | |
| JP | 5-322440 | | 12/1993 | |
| JP | 2568329 | | 4/1998 | |
| JP | 11-6683 | | 1/1999 | |
| JP | 11-325712 | | 11/1999 | |
| JP | 2001-12847 | | 1/2001 | |
| JP | 2007071490 | A | 3/2007 | |
| JP | 2010-181070 | | 8/2010 | |
| JP | 2011-202853 | | 10/2011 | |
| KR | 10-2007-0019218 | | 2/2007 | |
| KR | 10-0679652 | | 2/2007 | |
| KR | 20-2009-0007268 | | 7/2009 | |
| KR | 10-2010-0041033 | | 4/2010 | |
| KR | 10-2011-0006145 | | 1/2011 | |
| KR | 10-2011-0010406 | | 2/2011 | |
| WO | WO 2008/117505 | A1 | 10/2008 | |
| WO | WO 2008117505 | A1 | 10/2008 | |
| WO | WO 2010100909 | A1 | 9/2010 | |
| WO | 2011/118137 | A1 | 9/2011 | |
| WO | WO 2011/118137 | A1 | 9/2011 | |

OTHER PUBLICATIONS

Partial European Search Report dated Oct. 26, 2015 in corresponding European Patent Application No. 13163050.1.

Chinese Office Action dated Mar. 29, 2016 in related Chinese Patent Application No. 201310122679.7.

Office Action dated Jan. 17, 2014 in related U.S. Appl. No. 13/859,337.

Office Action dated Aug. 6, 2014 in related U.S. Appl. No. 13/859,337.

Office Action dated Jan. 16, 2015 in related U.S. Appl. No. 13/859,337.

Office Action dated May 11, 2015 in related U.S. Appl. No. 13/859,337.

Office Action dated Aug. 20, 2015 in related U.S. Appl. No. 13/859,337.

Office Action dated Feb. 1, 2016 in related U.S. Appl. No. 13/859,337.

Advisory Action dated Apr. 29, 2016 in related U.S. Appl. No. 13/859,337.

Notice of Allowance dated Sep. 19, 2016 in related U.S. Appl. No. 13/859,337.

Office Communication dated Jan. 5, 2015 in related U.S. Appl. No. 13/859,337.

Office Communication dated Apr. 17, 2015 in related U.S. Appl. No. 13/859,337.

Chinese Office Action dated Sep. 9, 2016 in corresponding Chinese Patent Application No. 201310122679.7.

European Office Action dated Jan. 19, 2017, in corresponding European Patent Application No. 13 136 050.1.

Chinese Office Action dated Feb. 13, 2017, in corresponding Chinese Patent Application No. 201310122679.7.

Chinese Office Action dated May 26, 2017, in corresponding Chinese Patent Application No. 201310122679.7.

European Office Action dated Jun. 14, 2017, in corresponding European Patent Application No. 13 163 050.1.

Extended European Search Report dated Feb. 1, 2018, in corresponding European Patent Application No. 17197912.3.

European Office Action dated Nov. 22, 2017, in corresponding European Patent Application No. 13 163 050.1.

Korean Office Action dated Jun. 26, 2018 in corresponding Korean Patent Application No. 10-2012-0037499.

European Office Action dated Jun. 28, 2018 in corresponding European Patent Application No. 13 163 050.1.

Chinese Office Action dated Jul. 3, 2018 in corresponding Chinese Patent Application No. 201610843577.8.

US Office Action dated Jul. 27, 2018 in U.S. Appl. No. 15/270,521.

U.S. Appl. No. 15/270,521, filed Sep. 20, 2016, Young Bae Hong, et al., Samsung Electronics Co., Ltd.

U.S. Appl. No. 13/859,337 (now U.S. Pat. No. 9,557,096), filed Apr. 9, 2013, Young Bae Hong, et al., Samsung Electronics Co., Ltd.

Extended European Search Report dated Jun. 3, 2019 in corresponding European Patent Application No. 19156885.6.

(56) References Cited

OTHER PUBLICATIONS

Chinese Office Action dated Mar. 22, 2019 in corresponding Chinese Patent Application No. 201610843577.8.
Korean Office Action dated Mar. 14, 2019 in corresponding Korean Patent Application No. 10-2019-0009503.
Korean Office Action dated Oct. 24, 2018 in Korean Patent Application No. 10-2012-0037499.
European Office Action dated Dec. 11, 2018 in European Patent Application No. 13 163 050.1.
Office Action dated Aug. 8, 2019 in co-pending U.S. Appl. No. 15/270,521.
Final Office Action dated Mar. 4, 2019 in co-pending U.S. Appl. No. 15/270,521.
Chinese Patent Office Action issued in Chinese Patent Application No. 201610843577.8 dated Sep. 18, 2019.
European Communication under Rule 71(3) EPC issued in European Patent Application No. 13 163 050.1 dated Jun. 26, 2019.
European Communication pursuant to Article 94(3) EPC issued in European Patent Application No. 17 197 912.3 dated Jul. 3, 2019.
Korean Patent Office issued Notice of Allowance in Korean Patent Application No. 10-2019-0009503 dated Aug. 9, 2019.
Final Office Action dated Feb. 11, 2020 in co-pending U.S. Appl. No. 15/270,521.
Communication dated Feb. 13, 2020 in European Patent Application No. 19156885.6.
Communication under Rule 71(3) EPC dated Apr. 1, 2020 in European Patent Application No. 17197912.3.

* cited by examiner

REFRIGERATOR

CROSS-REFERENCE TO RELATED APPLICATIONS

This application is a continuation of U.S. Ser. No. 15/270,521, filed Sep. 20, 2016, which is a continuation of U.S. Ser. No. 13/859,337, filed Apr. 9, 2013, and claims the benefit of Korean Patent Application No. 10-2012-0037499, filed on Apr. 10, 2012 in the Korean Intellectual Property Office, the disclosures of which are incorporated herein by reference.

BACKGROUND

1. Field

One or more embodiments of the present disclosure relate to a refrigerator including a sliding door configured to open and close a storage chamber and a storage basket provided on a rear portion of the sliding door.

2. Description of the Related Art

In general, a refrigerator is a home appliance that includes a storage chamber for storing food and a cold air supply device to supply cold air to the storage chamber to keep food fresh.

The storage chamber includes an opened front portion so that food is put in and taken out of the storage chamber, and the opened front portion of the storage chamber is opened or closed by a rotary door hinge-coupled to a main body or a sliding door slidably movable from/to the main body.

In general, a storage basket to store food is provided on a rear portion of the sliding door. In addition, a support frame is coupled to upper portions of both sidewalls of the storage basket, and the storage basket is movably supported by the support frame so as to be drawn into the storage chamber or drawn to the outside of the storage chamber. However, according to these conventional technologies, an empty space between lower portions of both sidewalls of the storage basket and an inner case is created.

SUMMARY

Therefore, it is an aspect of the present disclosure to provide, in a refrigerator including a sliding door, a storage basket that is provided on a rear surface of the sliding door, and a support frame that is coupled to an inner case and movably supports the sliding door and the storage basket, a structure of the storage basket and the support frame that can expand a storage space of the storage basket.

In addition, it is another aspect of the present disclosure to provide a coupling structure of a sliding door and a support frame that can increase a coupling force between the sliding door and the support frame.

In addition, it is still another aspect of the present disclosure to provide, in a refrigerator including an auxiliary basket supported by a storage basket, a structure of the storage basket and the auxiliary basket in which the auxiliary basket can be operated in conjunction with an operation of the storage basket.

Additional aspects of the disclosure will be set forth in part in the description which follows and, in part, will be apparent from the description, or may be learned by practice of the disclosure.

In accordance with one aspect of the present disclosure, a refrigerator including: a main body that includes an inner case and an outer case; a storage chamber that is formed so as to be opened at its front portion by the inner case; a sliding door that opens and closes the opened front portion of the storage chamber; a support frame that movably supports the sliding door with respect to the main body; and a storage basket that is drawn into and out of the storage chamber while being moved together with the sliding door when the sliding door is opened and closed, and supported by the support frame, wherein the storage basket includes both sidewalls, each of the both sidewalls includes a first wall and a second wall formed on an upper side of the first wall so as to protrude toward the inner case, and the support frame is disposed between the first wall and the inner case.

Here, each of the both sidewalls of the storage basket may include a coupling wall that connects the first wall and the second wall and is coupled to the support frame.

In addition, the second wall may have a vertical length larger than a vertical length of the first wall.

In addition, the support frame may include left and right rail units coupled to the inner case, a rear reinforcing frame configured to connect a rear portion of the left rail unit and a rear portion of the right rail unit, and a front reinforcing frame configured to connect a front portion of the left rail unit and a front portion of the right rail unit.

In addition, each of the left rail unit and the right rail unit may include a first cover rail fixedly coupled to the inner case, a first sliding rail fixedly coupled to the first cover rail, a second sliding rail movably coupled to the first sliding rail, a third sliding rail movably coupled to the second sliding rail, a second cover rail fixedly coupled to the third sliding rail, the sliding door, and the storage basket, a first sliding assisting member disposed between the first sliding rail and the second sliding rail, and a second sliding assisting member disposed between the second sliding rail and the third sliding rail.

In addition, a rack gear may be formed in the first cover rail, and a pinion gear engaged with the rack gear may be coupled to the third sliding rail.

In addition, a connection bar may be rotatably coupled to the third sliding rail, and the pinion gear is coupled to the connection bar.

In addition, the rear reinforcing frame and the front reinforcing frame may be coupled to the second cover rail.

In addition, a coupling protrusion that protrudes downward may be formed on a coupling wall of the storage basket, and a coupling hole to which the coupling protrusion is coupled may be formed in the support frame.

In addition, the refrigerator may further include a coupling bracket that enables the sliding door and the support frame to be coupled with each other, wherein the coupling bracket may include a first coupling unit coupled with the sliding door, a second coupling unit coupled with the support frame, and a reinforcing unit configured to connect the first coupling unit and the second coupling unit so as to reinforce rigidity of the coupling bracket.

In addition, the reinforcing unit may have a plate shape that is perpendicularly disposed, and have a longitudinal length that is gradually increased toward a lower side thereof.

In addition, the refrigerator may further include an auxiliary basket that is drawn into and out on an upper side of the storage basket of the storage chamber and supported by the storage basket, wherein the auxiliary basket includes a first roller configured to perform a rolling motion, and the storage basket includes a roller support surface configured to support the first roller, a front protrusion configured to protrude upward from a front portion of the roller support surface, a rear protrusion configured to protrude upward from a rear portion of the roller support surface, and an auxiliary protrusion configured to protrude upward between the front and rear protrusions of the roller support surface.

In accordance with another aspect of the present disclosure, a refrigerator including: a main body that includes an inner case and an outer case; a storage chamber that is formed so as to be opened at its front portion by the inner case; a sliding door that opens and closes the opened front portion of the storage chamber; a support frame that movably supports the sliding door with respect to the main body; a storage basket that is drawn into and out of the storage chamber while being moved together with the sliding door when the sliding door is opened and closed, and supported by the support frame; and a coupling bracket that enables the support frame to be coupled to the sliding door, wherein the coupling bracket includes a first coupling unit coupled with the sliding door, a second coupling unit coupled with the support frame, and a reinforcing unit configured to connect the first coupling unit and the second coupling unit.

Here, the reinforcing unit may have a plate shape that is perpendicularly disposed, and have a longitudinal length that is gradually increased toward a lower side thereof.

In accordance with still another aspect of the present disclosure, a refrigerator including: a main body that includes an inner case and an outer case; a storage chamber that is formed so as to be opened at its front portion by the inner case; a sliding door that opens and closes the opened front portion of the storage chamber; a support frame that movably supports the sliding door with respect to the main body; a storage basket that is drawn into and out of the storage chamber while being moved together with the sliding door when the sliding door is opened and closed, and supported by the support frame; and an auxiliary basket that is supported by the storage basket, and drawn into and out on an upper side of the storage basket of the storage chamber, wherein the auxiliary basket includes a first roller configured to perform a rolling motion, and the storage basket includes a roller support surface configured to support the first roller, a front protrusion configured to protrude upward from a front portion of the roller support surface, a rear protrusion configured to protrude upward from a rear portion of the roller support surface, and an auxiliary protrusion configured to protrude upward between the front and rear protrusions of the roller support surface.

Here, a roller housing unit for preventing the auxiliary basket from being relatively moved to the storage basket when external force does not act on the auxiliary basket may be formed between the front protrusion and the auxiliary protrusion.

In addition, when the storage basket is drawn out while the first roller is housed in the roller housing unit, the auxiliary protrusion may pressurize the first roller, so that the auxiliary basket may be drawn out together with the storage basket.

In addition, when the auxiliary basket is drawn in while the first roller of the auxiliary basket is housed in the roller housing unit of the storage basket, the first roller may be moved over the auxiliary protrusion, and only the auxiliary basket may be drawn in while the storage basket is not moved.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
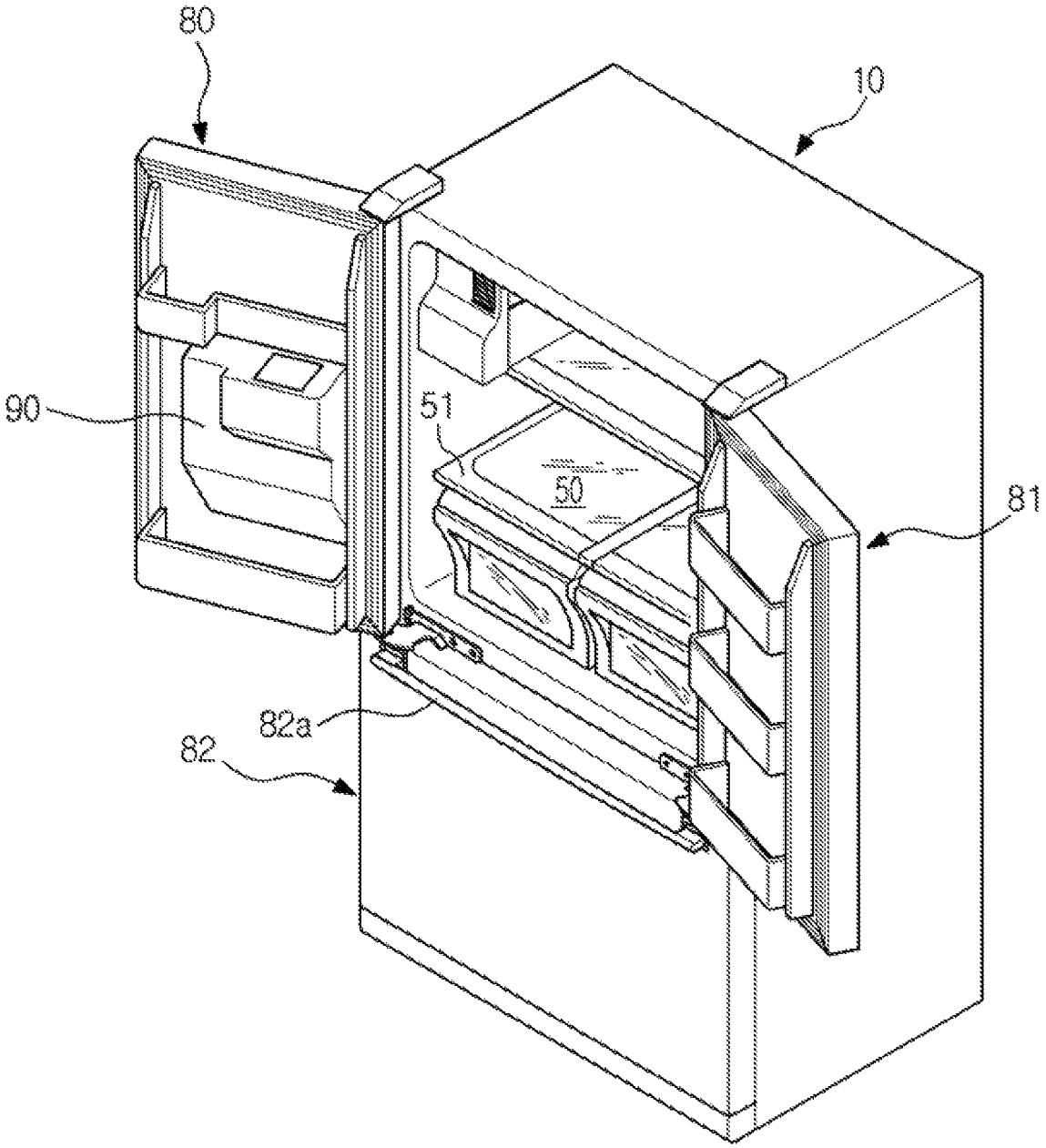
FIG. 1 is a perspective view showing an appearance of a refrigerator in accordance with an embodiment of the present disclosure.

Reference will now be made in detail to embodiments of the present disclosure, examples of which are illustrated in the accompanying drawings, wherein like reference numerals refer to like elements throughout.

Figure 2:
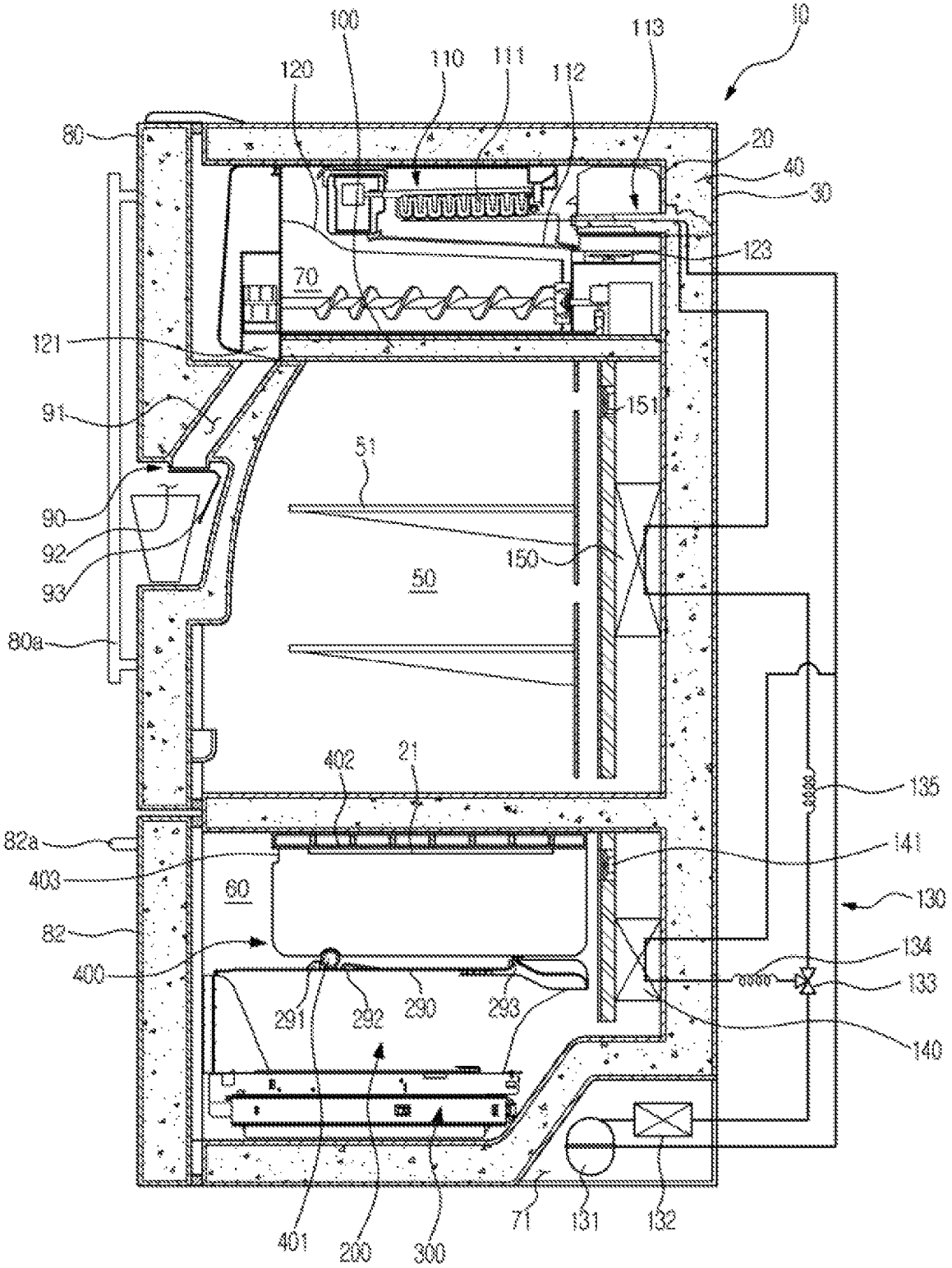
FIG. 2 is a schematic side cross-sectional view showing the refrigerator of FIG. 1.

FIG. 1 is a perspective view showing an appearance of a refrigerator in accordance with an embodiment of the present disclosure, and FIG. 2 is a schematic side cross-sectional view showing the refrigerator of FIG. 1.

Referring to FIGS. 1 and 2, the refrigerator in accordance with an embodiment of the present disclosure includes a main body 10, storage chambers 50 and 60 that are formed inside the main body 10, an ice-making chamber 70, and a cold air supply device that supplies cold air to the one or more storage chambers 50 and 60 and the ice-making chamber 70.

The main body 10 includes an inner case 20 that forms the storage chambers 50 and 60 and the ice-making chamber 70, an outer case 30 that is coupled to an outer portion of the inner case 20 and forms an appearance of the refrigerator, and a heat insulating material 40 of the main body 10 that is foamed between the inner case 20 and the outer case 30.

The storage chambers 50 and 60 include a refrigerating chamber 50 on the upper portion and a freezing chamber 60 on the lower portion, and the storage chambers 50 and 60 include an opened front portion. A shelf 51 on which food is placed may be disposed inside the refrigerating chamber 50. However, a location and a number of storage chambers are not limited thereto. For example, the refrigerator may include at least one storage chamber, and the freezing chamber may be installed in the upper portion of the refrigerator and the refrigerating chamber may be provided in the lower portion of the refrigerator.

The opened front portion of the refrigerating chamber 50 may be opened and closed by a plurality of doors 80 and 81 which are hinge-coupled to the main body 10 so as to be rotated, and the opened front portion of the freezing chamber 60 may be opened and closed by a sliding door 82 that is slidably movable from/to the main body 10. Handles 80*a* and 82*a* may be respectively provided in the doors 80, 81, and 82. The refrigerator may the refrigerating chamber opened and closed by the sliding door or the freezing chamber opened and closed by the rotating doors.

A dispenser 90 through which water or ice inside the refrigerator may be taken out even without opening the doors 80 and 81 may be provided in any one of the plurality of doors 80 and 81.

The dispenser 90 may include a guide passage 91 that guides ice discharged from an ice discharging port 121 of an ice bucket 120 to the outside, a take-out space 92 in which a vessel such as a cup is put to receive water or ice, and an operating lever 93 through which water or ice can be taken out.

The ice-making chamber 70 may be formed in a corner of an upper portion of the inner case 20. The ice-making chamber 70 may be formed between the inner case 20 of the ice-making chamber 70 and a case 100 of the ice-making chamber 70 coupled on an inner portion of the inner case 20.

In the ice-making chamber 70, an ice-making tray 110 to which water is fed to create ice, an ejector 111 that moves the ice created in the ice-making tray 110, an ice bucket 120 that stores the ice moved from the ice-making tray 110, a drain duct 112 that collects defrost water of the ice-making tray 110, and a blower fan 123 of the ice-making chamber that forcibly causes air inside the ice-making chamber 70 to flow may be provided.

In addition, a part of a refrigerant tube 130 may be inserted into the ice-making chamber 70 so that cold air is directly created by the ice-making chamber 70, and a heat insulating material 113 of the refrigerant tube 130 may be coupled to the refrigerant tube 130 so as to prevent implantation due to a temperature difference with ambient air.

The cold air supply device may include a compressor 131 that compresses refrigerant, a condenser 132 that condenses refrigerant, a flow passage switching valve 133 that switches a flow passage of refrigerant, expanding devices 134 and 135 that expand refrigerant, evaporators 140 and 150 that evaporate refrigerant to create cold air, and blower fans 141 and 151 that cause cold air to flow. The compressor 131 and the condenser 132 may be included in a mechanical chamber 71 provided in the lower portion of the refrigerator.

The refrigerator according to an embodiment of the present disclosure may further include a storage basket 200 that is slidably drawn into and out of the freezing chamber 60, a support frame 300 that movably supports the sliding door 82 and the storage basket 200, and an auxiliary basket 400 that is slidably drawn into and out on an upper portion of the storage basket 200 of the freezing chamber 60. A structure of each of the storage basket 200 and the support frame 300 will be described later.

In the auxiliary basket 400, a first roller 401 configured to perform a rolling motion on the storage basket 200 may be provided. Here, the storage basket 200 may include a roller support surface 290 that supports the first roller 401 configured to perform the rolling motion, and a front protrusion 291, an auxiliary protrusion 292, and a rear protrusion 293 that respectively protrude upward from the roller support surface 290 so that a position of the auxiliary basket 400 is limited by pressurizing the first roller 401. The front protrusion 291, the auxiliary protrusion 292, and the rear protrusion 293 of the storage basket 200 will be described later.

In addition, in the auxiliary basket 400, a sliding protrusion 402 that protrudes toward sides may be formed. The sliding protrusion 402 may be slidably supported by a support protrusion 21 formed on an inner portion of the inner case 20.

A handle 403 may be provided in the auxiliary basket 400, so that the auxiliary basket 400 may be drawn out forward or drawn in backward while a user grasps the handle 403.

Figure 3:
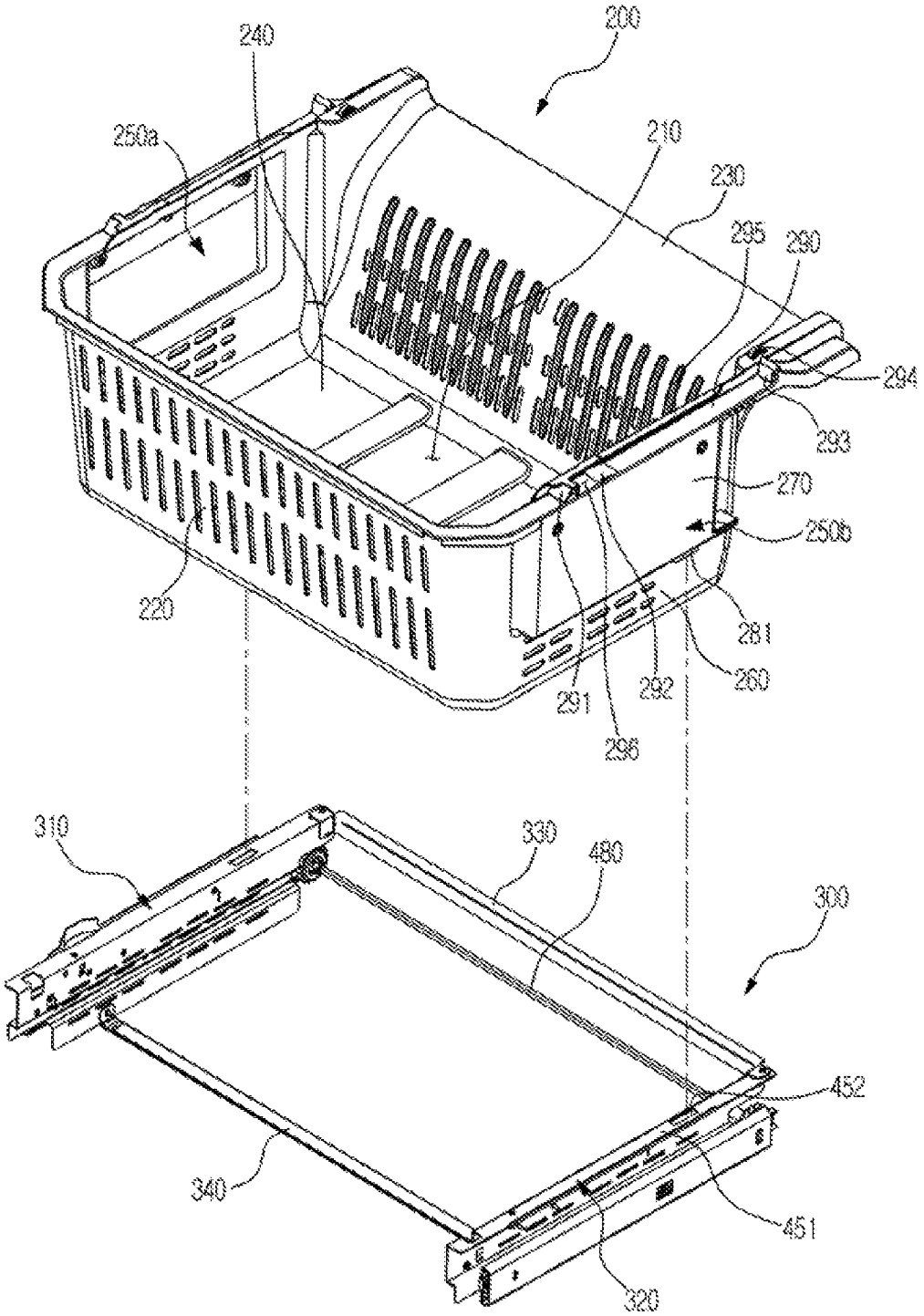
FIG. 3 is a perspective view showing a storage basket and a support frame of the refrigerator of FIG. 1.
Figure 4:
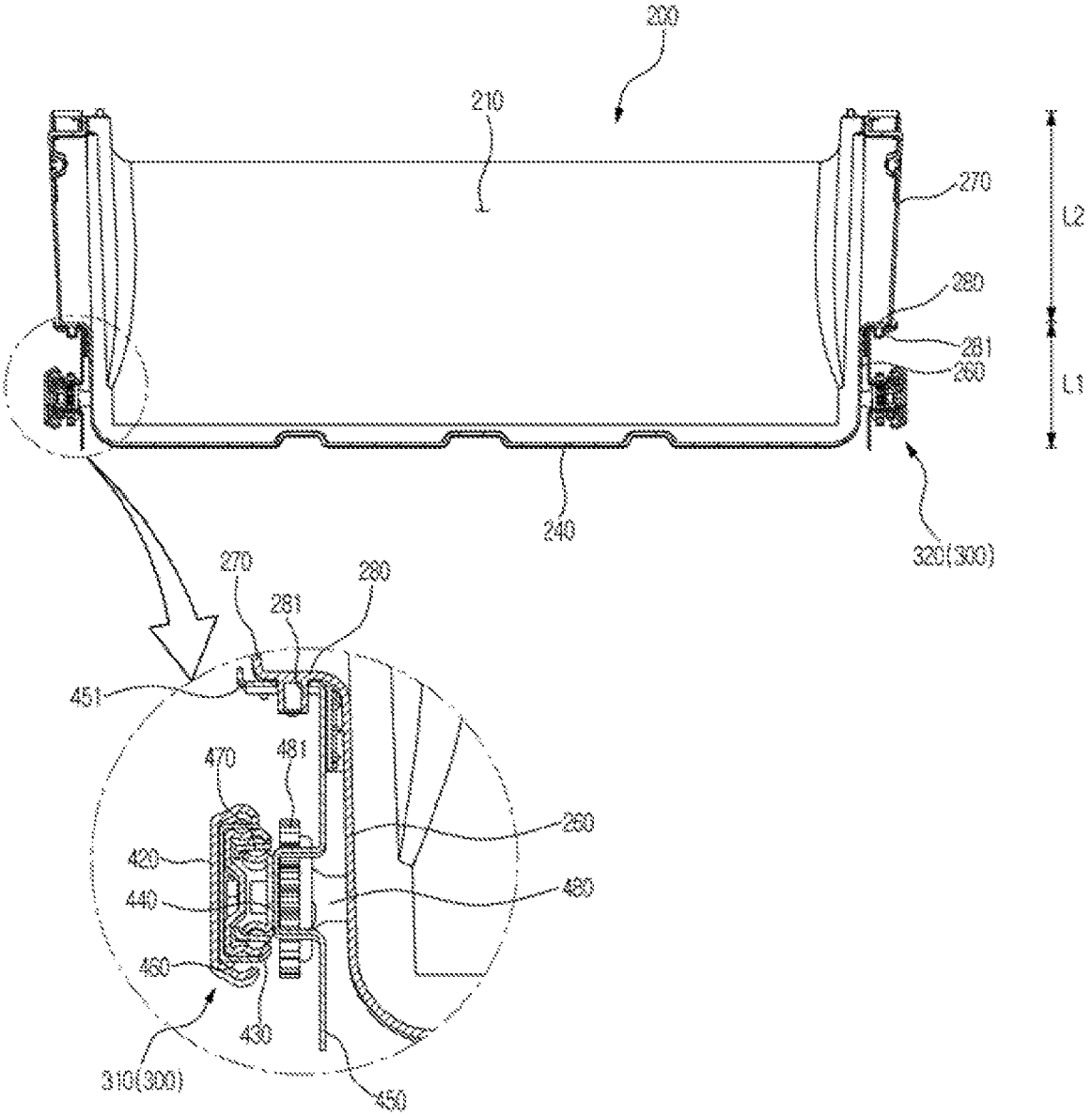
FIG. 4 is a cross-sectional view showing a storage basket and a support frame of the refrigerator of FIG. 1.
Figure 5:
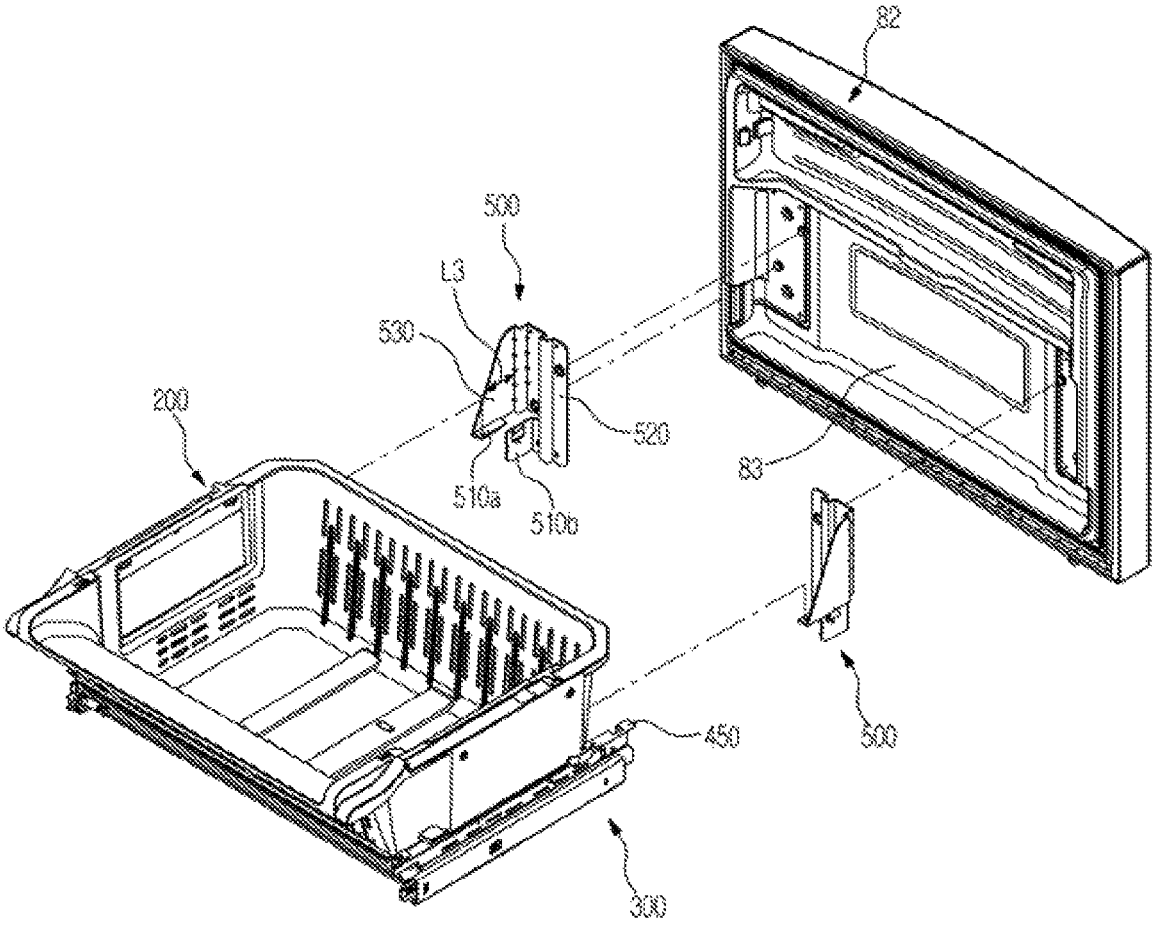
FIG. 5 is a view showing a coupling relationship between a sliding door and a support frame of the refrigerator of FIG. 1.
Figure 6:
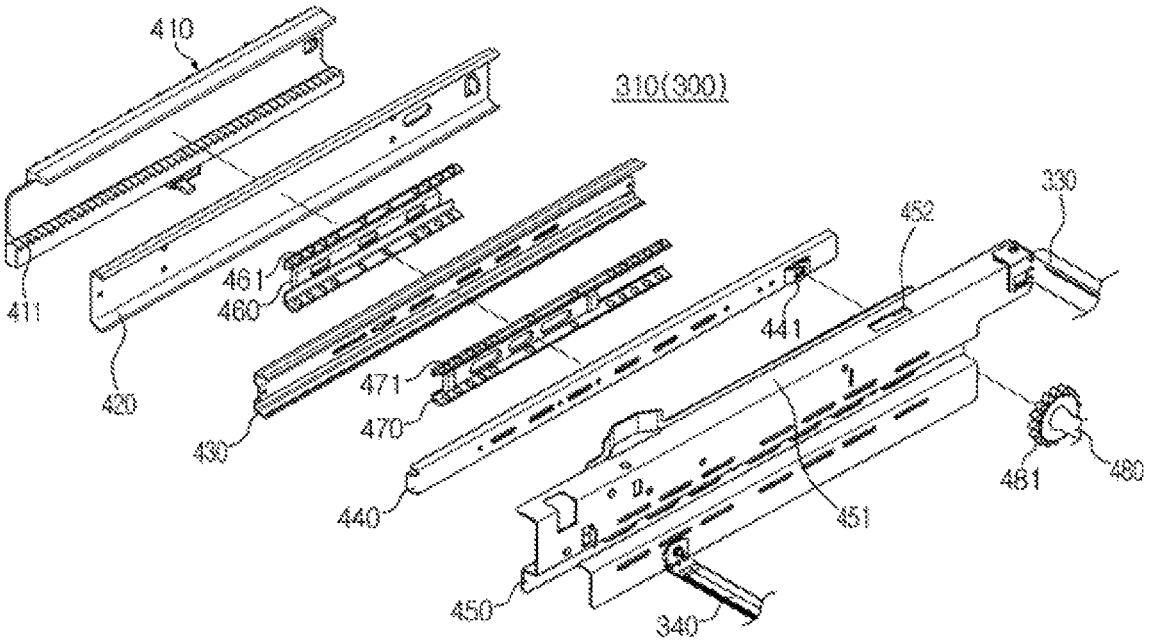
FIG. 6 is an exploded view showing a rail unit of the refrigerator of FIG. 1.

FIG. 3 is a perspective view showing a storage basket and a support frame of the refrigerator of FIG. 1, FIG. 4 is a cross-sectional view showing a storage basket and a support frame of the refrigerator of FIG. 1, FIG. 5 is a view showing coupling relationship between a sliding door and a support frame of the refrigerator of FIG. 1, and FIG. 6 is an exploded view showing a rail unit of the refrigerator of FIG. 1.

Referring to FIGS. 1 to 6, the storage basket 200 of the refrigerator in accordance with an embodiment of the present disclosure may have a storage space 210 that may store food. An upper surface of the storage basket 200 may be opened, and food may be put in and taken out of the storage space 210 through the opened upper portion. In addition, the storage basket 200 has a front wall 220, a rear wall 230, both sidewalls 250*a* and 250*b*, and a bottom wall 240.

In particular, as shown in FIG. 4, the both sidewalls 250*a* and 250*b* of the storage basket 200 include a first wall 260 on a lower portion, a second wall 270 that protrudes outwardly from the first wall 260, and a coupling wall 280 that connects the first wall 260 and the second wall 270 and is approximately horizontally formed. Here, a vertical length L1 of the first wall 260 is formed to be smaller than a vertical length L2 of the second wall 270. Rail units 310 and 320 of the support frame 300 may be disposed between the first wall 260 and the inner case 20. The lengths of the first wall 260 and the coupling wall 280 may have a predetermined length to accommodate the support frame 300 so that the storage basket 200 may be drawn into and out of the freezing chamber 200. In other words, based on the size of the support frame 300, the lengths the first wall 260 and the coupling wall 280 may be changed accordingly to accommodate the support frame 300. The length of second wall may be proportionally changed based on the changes in the length of the first wall 260.

By the above-described structure, the storage basket 200 of the refrigerator in accordance with an embodiment of the present disclosure has a wider storage space 210 than the conventional storage basket having a flat sidewall.

The storage basket 200 may be supported by the support frame 300 in such a manner that a coupling wall 280 formed between the first wall 260 and the second wall 270 is placed on a storage basket support surface 451 of the support frame 300.

Here, a coupling protrusion 281 that protrudes downward may be formed in the coupling wall 280 of the storage basket 200, and a coupling hole 452 to which the coupling protrusion 281 is inserted may be formed in the support frame 300. Accordingly, the coupling protrusion 281 may be inserted into the coupling hole 452, so that the storage basket 200 may be fixed to the support frame 300.

In an upper portion of the storage basket 200, the roller support surface 290 through which the first roller 401 of the auxiliary basket 400 is supported, a roller support guide 295 that guides the movement of the first roller 401, the front protrusion 291 that protrudes upward from the front portion of the roller support surface 290, the rear protrusion 293 that protrudes upward from the rear portion of the roller support surface 290, the auxiliary protrusion 292 that protrudes upward between the front protrusion 291 and the rear protrusion 293 of the roller support surface 290, and a second roller 294 that is coupled with a rear surface of the auxiliary basket 400 so as to perform a rolling motion.

The front protrusion 291 may act as a front stopper that limits a forward relative position of the auxiliary basket 400 with respect to the storage basket 200, and the rear protrusion 293 may act as a rear stopper that limits a rearward relative position of the auxiliary basket 400 with respect to the storage basket 200. Accordingly, each of the front protrusion 291 and the rear protrusion 293 is preferably formed to have a predetermined height so that the first roller 401 is not moved over the front protrusion 291 and the rear protrusion 293.

The front protrusion 291 may pressurize the first roller 401 so that the storage basket 200 is drawn in together with the auxiliary basket 400 in conjunction with the auxiliary basket 400.

The auxiliary protrusion 292 may be formed so as to be close to the front protrusion 291 between the front protrusion 291 and the rear protrusion 293. A roller housing unit 296 in which the first roller 401 is housed may be formed between the front protrusion 291 and the auxiliary protrusion 292, and the auxiliary basket 400 may not be relatively moved to the storage basket 200 when force is not directly applied to the auxiliary basket 400 in a state in which the first roller 401 is housed in the roller housing unit 296.

Accordingly, when the storage basket 200 is drawn out while the first roller 401 is housed in the roller housing unit 296, the auxiliary protrusion 292 may pressurize the first roller 401, and the auxiliary basket 400 may be drawn out together with the storage basket 200.

As described above, when the storage basket 200 is drawn in while the first roller 401 is housed in the roller housing unit 296, the front protrusion 291 may pressurize the first roller 401, and the auxiliary basket 400 may be drawn in together with the storage basket 200.

The auxiliary protrusion 292 may be formed to have a slightly lower height than the front protrusion 291 and the rear protrusion 293 so that the first roller 401 may be moved over the auxiliary protrusion 292.

Accordingly, when the auxiliary basket 400 is drawn in by directly applying force to the auxiliary basket 400 in a state in which the first roller 401 is housed in the roller housing unit 296, the first roller 401 may be moved over the auxiliary protrusion 292, and only the auxiliary basket 400 may be drawn in while the storage basket 200 is not moved.

The support frame 300 includes left and right rail units 310 and 320 that are respectively coupled to the inner case 20, a rear reinforcing frame 330 that connects a rear portion of the left rail unit 310 and a rear portion of the right rail unit 320, and a front reinforcing frame 340 that connects a front portion of the left rail unit 310 and a front portion of the right rail unit 320.

The rear and front reinforcing frames 330 and 340 may prevent distortion of the left and right rail units 310 and 320.

As shown in FIG. 6, each of the left and right rail units 310 and 320 (only left rail unit 310 is shown) may include a first cover rail 410 that is fixedly coupled to the inner case 20, a first sliding rail 420 that is fixedly coupled to the first cover rail 410, a second sliding rail 430 that is movably coupled to the first sliding rail 420, a third sliding rail 440 that is movably coupled to the second sliding rail 430, a second cover rail 450 that is fixedly coupled to the third sliding rail 440, the sliding door 82, and the storage basket 200, a first sliding assisting member 460 that is disposed between the first sliding rail 420 and the second sliding rail 430 and has a ball member 461, and a second sliding assisting member 470 that is disposed between the second sliding rail 430 and the third sliding rail 440 and has a ball member 471.

A rack gear 411 may be formed in the first cover rail 410, and a pinion gear 481 that is engaged with the rack gear 411 may be coupled to the third sliding rail 440. The pinion gear 481 may be coupled to a connection bar 480 that is rotatably coupled to a connection bar receiving part 441 of the third sliding rail 440.

The above-described rear and front reinforcing frames 330 and 340 may be coupled to the second cover rail 450 to which the sliding door 82 and the storage basket 200 are coupled.

In addition, the above-described coupling hole 452 and storage basket support surface 451 may also be formed in the second cover rail 450.

The refrigerator in accordance with an embodiment of the present disclosure may further include a coupling bracket 500 that enables the sliding door 82 and the support frame 300 to be coupled with each other.

The coupling bracket 500 may include a first coupling unit 520 coupled with a rear surface 83 of the sliding door 82, second coupling units 510*a* and 510*b* coupled with the second cover rail 450 of the support frame 300, and a reinforcing unit 530 that connects the first coupling unit 520 and the second coupling units 510*a* and 510*b* to reinforce rigidity of the coupling bracket 500.

The reinforcing unit 530 may be provided to have a plate shape that is approximately perpendicularly disposed, and a longitudinal length L3 of the reinforcing unit 530 may be increased toward a lower portion thereof.

By this structure, the support frame 300 coupled to a lower portion of the sliding door 82 may be prevented from being spread out from the sliding door 82 or fallen behind the sliding door 82, and may be firmly coupled to the sliding door 82.

As described above, in accordance with embodiments of the present disclosure, the lower wall in which the support frame is disposed among the sidewalls of the storage basket protrudes inward, and the upper wall in which the support frame is not disposed protrudes outward, and therefore an inner storage space of the storage basket may be expanded.

In addition, the coupling bracket that enables the sliding door and the support frame to be coupled with each other includes the first coupling unit that is coupled with the sliding door, the second coupling unit that is coupled with the support frame, and the reinforcing unit that connects the first coupling unit and the second coupling unit, and therefore a coupling force between the sliding door and the support frame may be strengthened.

In addition, the front protrusion, the rear protrusion, and the auxiliary protrusion are provided in the storage basket, and therefore the auxiliary basket may be moved in conjunction with the movement of the storage basket.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a main body;

a storage compartment provided in the main body;

a door to open or close the storage compartment;

a storage basket, which moves together with the door, to be drawn into or out of the storage compartment; and an auxiliary basket supported by the storage basket, the auxiliary basket including a roller;

wherein the storage basket includes:

a roller support surface configured to support the roller so that the roller performs a rolling motion, a front protrusion protruding upward from a front portion of the roller support surface, the front protrusion configured to press against the roller to restrict a forward movement of the roller along the roller support surface when the door is being closed, a rear protrusion protruding upward from a rear portion of the roller support surface to restrict a backward movement of the roller along the roller support surface, and an auxiliary protrusion protruding upward from the roller support surface between the front protrusion and the rear protrusion, and being positioned closer to the front protrusion than the rear protrusion, so that, when the roller is supported on the roller support surface and disposed between the front protrusion and the auxiliary protrusion, the auxiliary basket is drawn out together with the storage basket by the auxiliary protrusion pressing against the roller as the door is being opened, and the auxiliary basket is drawn in together with the storage basket by the front protrusion pressing against the roller as the door is being closed, wherein the auxiliary protrusion is formed to have a lower height than the front protrusion to enable the roller to be moved over the auxiliary protrusion.

2. The refrigerator according to claim 1, wherein the auxiliary protrusion is formed in a shape such that a height of the auxiliary protrusion decreases toward a rear of the storage compartment.

3. The refrigerator according to claim 1, wherein the auxiliary protrusion and the front protrusion are configured so that, when a force is directly applied to the auxiliary basket while the roller is disposed between the front protrusion and the auxiliary protrusion, the roller is moved over the auxiliary protrusion, and the auxiliary basket is drawn in while the storage basket is not moved.

4. The refrigerator according to claim 1, wherein the storage basket is configured to be drawn out while the auxiliary basket is not moved after the roller moves over the auxiliary protrusion toward the rear protrusion.

5. The refrigerator according to claim 1, wherein the auxiliary basket is configured to be drawn out together with the storage basket until the roller moves over the auxiliary protrusion when the storage basket is drawn out.

6. The refrigerator according to claim 1, wherein the auxiliary basket is configured to be movable relative to the storage basket when the roller is disposed between the auxiliary protrusion and the rear protrusion.

* * * * *